United States Patent [19]

Cronk

[11] 4,273,467

[45] Jun. 16, 1981

[54] ADJUSTABLE MANHOLE COVER SUPPORT

[75] Inventor: Allan D. Cronk, West Vancouver, Canada

[73] Assignee: Cremo Supply Ltd., West Vancouver, Canada

[21] Appl. No.: 51,595

[22] Filed: Jun. 25, 1979

[30] Foreign Application Priority Data

Oct. 13, 1978 [CA] Canada ..... 313373

[51] Int. Cl.[3] ..... E02D 29/14

[52] U.S. Cl. ..... 404/26; 210/163; 52/20

[58] Field of Search ..... 404/26, 25; 210/163, 210/164; 52/20, 19

[56] References Cited

U.S. PATENT DOCUMENTS

| | | | |
|---|---|---|---|
| 1,076,386 | 10/1913 | O'Day | 404/26 |
| 2,930,295 | 3/1960 | Hale | 404/26 |
| 3,263,579 | 8/1966 | Dorris | 404/26 |
| 3,392,640 | 7/1968 | Zeile | 404/26 |
| 3,408,778 | 11/1968 | Mason | 404/26 X |
| 3,773,428 | 11/1973 | Bowman | 404/26 |
| 3,858,998 | 1/1975 | Larsson | 404/26 |
| 3,930,739 | 1/1976 | Larsson | 404/26 |
| 4,015,373 | 4/1977 | Boissier | 404/25 X |
| 4,149,816 | 4/1979 | Piso | 404/26 |

FOREIGN PATENT DOCUMENTS

| | | | |
|---|---|---|---|
| 1249860 | of 1971 | United Kingdom | 404/26 |

*Primary Examiner*—Nile C. Byers, Jr.
*Attorney, Agent, or Firm*—Townsend and Townsend

[57] ABSTRACT

An adjustable manhole cover support. The support comprises an outer ring having a circular internal opening. Threaded members are disposed about the interior of the circular opening. An insert is dimensioned to fit within the outer ring to a depth controlled by the abutment of the insert against the threaded members. Studs engage and extend through the threaded members to abut the under surface of the insert to provide control of the depth of the insert into the outer ring and the angulation of the outer ring. The support is simple to make, easy to adjust and trouble-free in operation.

7 Claims, 4 Drawing Figures

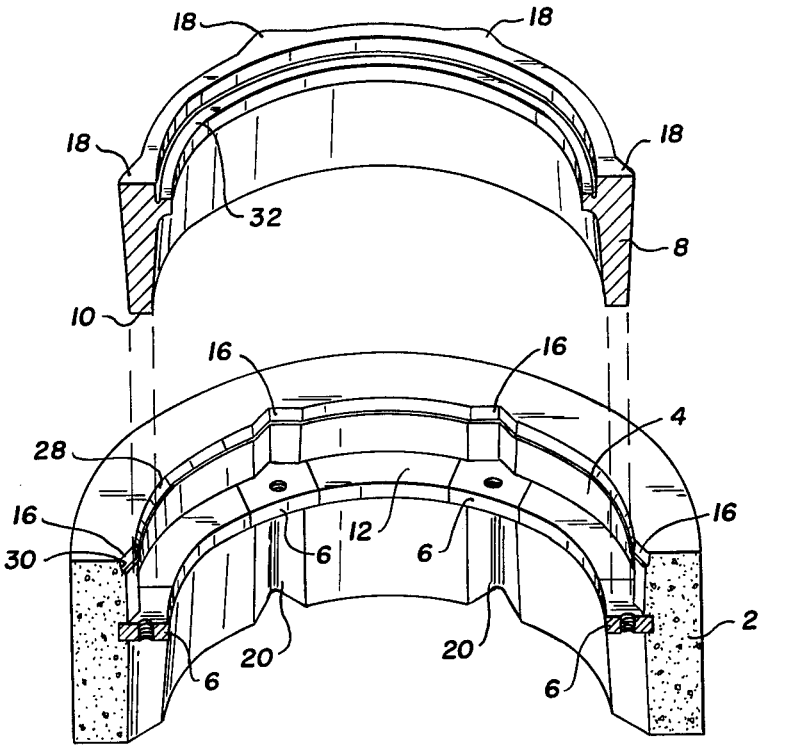
FIG. 1.
FIG. 3.
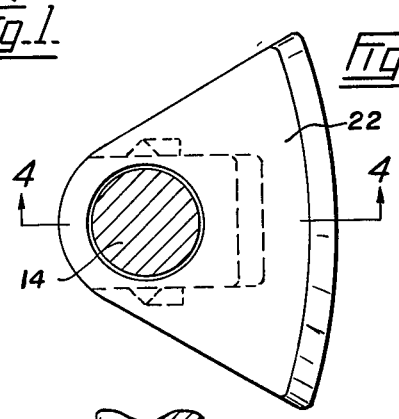
FIG. 2.
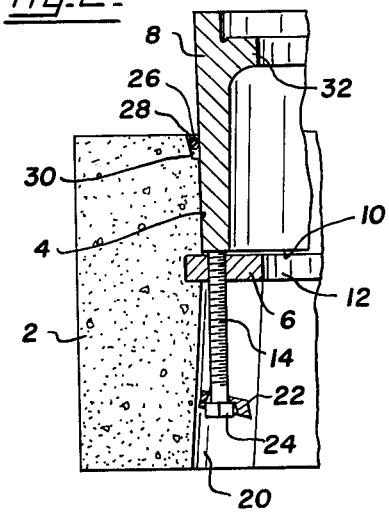
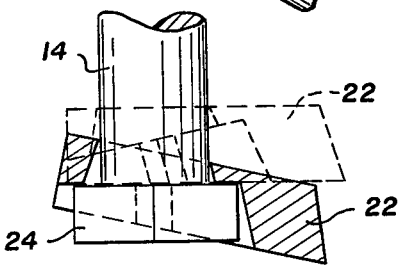
FIG. 4.

ADJUSTABLE MANHOLE COVER SUPPORT

FIELD OF THE INVENTION

This invention relates to an adjustable manhole cover support.

DESCRIPTION OF THE PRIOR ART

A manhole is an opening in any surface large enough to allow workmen to descend beneath the surface to obtain access to stored materials or equipment or underground installations. The openings are normally in areas carrying traffic so that a means of securely framing and covering the opening must be provided. The manholes must also be strong enough to withstand all external loadings, for example the loading of vehicles moving over the manhole.

In the prior art the standard procedure has been to frame the opening with a grey iron casting. The casting incorporates a flanged surface that rests on supporting structure under ground. This supporting structure typically comprises standard concrete rings long enough so that a number of them form a passage to reach the underground installation.

The flanged surface of the manhole transmits the weight of the equipment, together with live surface loads, to the supporting structure.

The frame typically incorporates an inwardly projecting ledge around the circumference and a cast iron cover rests on the ledge and closes the manhole.

The cover is a removable casting designed to carry the surface loads, and must transmit those forces to the underground supporting structure through the frame. The cover must be heavy to avoid vandalism. In some cases it is bolted down in order to make the installation watertight and tamper proof.

When another layer of surfacing material, for example, asphalt, is added to the road surface it becomes necessary either to raise the manhole frame to the new road level or to insert an extension piece called a "riser ring" between the frame and the cover. The level of the frame is then adjusted by filling the space between the frame flange and the supporting structure with layers of bricks and mortar. This is a manual, time consuming procedure. Furthermore, should the relationship between the road surface and the frame be altered, either by settling of the road or by the addition of another surface layer, the assembly must be dismantled and the brick and mortar courses be reformed.

All adjustments for height and, in particular, slope angle, must be made by attempting to fill the space under the frame flange with bricks and mortar.

Other methods of changing the level of the frame and cover are to insert a riser ring in the frame of the length required to meet the new road surface. This method appears easy to perform but there are a number of problems. First, the minimum raise must be approximately two inches to correspond with the standard riser ring. Secondly, the top is parallel to the initial installation and no further slope angle adjustment can be made. Thirdly, severe loadings tend to warp the riser ring and cause the cover to rock because of the uneven seating. It can thus be difficult to line up the frame top exactly with the finished grade and to maintain an alignment.

It is clear that it is desirable to be able to adjust the frame position without disturbing the below grade setting. This has been done by inserting spacer rings under the frame but, again, a disadvantage in this procedure is the lack of accommodation for slopes and the fact that the rings are available only in standard depths.

There have been suggestions that the movable frame be adjusted by independent screw threads so that it can be raised, lowered or tilted in an infinite variety of positions without spacers or riser rings. Examples of these schemes are indicated in U.S. Pat. Nos. 1,076,386; 2,930,295; 3,263,579; and 3,773,428. They feature the use of screw threads in which the adjustment is from the top.

However, the suggested methods have not obtained popularity. There are a number of difficulties with them. For example, the adjusting screws are often concealed by an enlarged manhole cover. However, cities and municipalities prefer the obvious economy of a standard, interchangeable cover. Secondly, the manhole frames often contain hollow sections for the screw mechanism and these must be provided in the casting by cores; this increases the cost of the casting. Furthermore, locking devices are necessary as all the adjustments for these screw thread mechanisms are from the top of the frame, that is adjustments are made from the road surface. The locking devices can be difficult to remove when further adjustments are required. This is because of the small size and the limited space available in typical designs.

Because the screw mechanisms are positioned adjacent the road surface plugging of the screw mechanism and abrasion by road materials is easy. Grease fittings have been used to avoid the abrasion and corrosion but that increases the expense of the assembly and, of course, introduces relatively small parts that can be lost in installation or omitted in assembly.

SUMMARY OF THE INVENTION

The present invention seeks to provide a manhole cover that is simple to produce and simple to install and adjust. The device uses a screw mechanism that is positioned underground where it is not easily corroded or abraded.

Accordingly, in a first aspect, the present invention is an adjustable manhole cover support comprising an outer ring having a circular internal opening; a plurality of threaded members disposed about the interior of said circular opening; an insert dimensioned to fit within the outer ring to a depth controlled by the abutment of the insert against the threaded members; studs to engage and to extend through the threaded members to abut the under surface of the insert to provide control of the depth of the insert into the outer ring and the angulation of the outer ring.

In a preferred aspect there are recesses in the external periphery of the outer rings and corresponding projections on the insert. There are threaded inserts positioned within each projection. Futhermore it is desirable that the each stud comprise a bolt having an enlarged head and that there be a locking member adapted to lock on the head. The bolts are desirably provided in recesses below the insert so that the studs and their locking mechanisms do not interfere with access into the manhole.

It is desirable that the locking mechanisms engage with the walls of the recesses and be a loose fit over the head of the bolt. By that means adjustment of a stud, and thus of the insert supported on the studs, is a simple matter.

BRIEF DESCRIPTION OF THE DRAWINGS

Aspects of the invention are illustrated, merely by way of example, in the accompanying drawings in which:

FIG. 1 is an exploded, sectional view of part of an adjustable manhole cover support according to the present invention;

FIG. 2 is a detail of FIG. 1 but showing a bolt and keeper in position;

FIG. 3 is a detail illustrating the keeper in position on the bolt; and

FIG. 4 is a section on the line 4—4 of FIG. 3.

DESCRIPTION OF THE PREFERRED EMBODIMENTS

The drawings illustrate an adjustable manhole cover support comprising an outer ring 2 having a circular internal opening 4. There are a plurality of threaded members 6 disposed about the interior of the circular opening 4. An insert 8 is dimensioned to be a loose, slidable fit within the outer ring 2 and the depth of insertion is controlled by the abutment of the lower surface 10 of the insert 8 against the threaded members 6. FIG. 1 illustrates a preferred embodiment. In that embodiment the threaded members 6 make up a part of a flange 12 extending around the periphery of the opening 4 to give increased support to the insert 8.

Although not shown in FIG. 1 but as shown in FIGS. 2 to 4 there are bolts 14 engage and to extend through the members 6 to abut the lower surface 10 of the insert 8. By moving bolts 14 upwardly or downwardly in the threaded members 6, the depth of insertion of the insert 8 can be controlled and, of course, the angulation of the insert 8. A particularly preferred embodiment has six threaded members 6 and, of course, a corresponding number of bolts 14, positioned around the internal opening 4.

In the preferred embodiment illustrated there are recesses 16 in the interior of the outer ring 2. There are corresponding projections 18 on the insert 8. The arrangement is such that the threaded members 6 are each positioned at the base of a recess 16. Furthermore beneath the members 6 there are second recesses 20 in the outer ring 2 one beneath each threaded member 6. As shown in FIG. 2 these second recesses 20 act as a protection for the bolts 14 and also provide a means of locating a keeper 22. In the preferred embodiment of FIGS. 2 and 3 it should be noted that the stud is, in fact, a bolt having a head. The keeper 22 is a locking member that, as shown in FIG. 3, is shaped on a portion of its exterior to correspond to the shape of a second recess 20.

As shown particularly in FIG. 4 the arrangement is such that the keeper 22 acts to lock the bolt 14, that is to prevent its inadvertent rotation, when the keeper 22 falls over head 24 of the bolt 14. However, when it is desired to adjust the bolt 14 a wrench (not shown) can be placed on the head 24 and used first to push the keeper 22 upwardly in a second recess 20. The wrench is then placed on head 24 and the adjustment to bolt 14 is made by turning the bolt to the required position. Upon removal of the wrench the keeper 22 simply falls back in position on the head and automatically prevents further, inadvertent rotation. The lock position for the keeper is shown in solid lines in FIG. 4, the free position in broken lines.

In the preferred embodiment illustrated there is a sealing strip 26 positioned at the top of the internal opening 4. The sealing strip 26 prevents the ingress of dirt that can interfere with the manhole cover support, particularly with the adjustment means. Channel 28 accommodates the sealing strip 26. Sealing strip 26 is desirably of circular section and of foamed polyethylene. It is also desirable that channel 28 has a wall 30 sloped at about 15° to accommodate various size strips 26 and to change in the size of one strip and to facilitate positioning of the sealing strip 26 in the channel 28.

In use, the outer ring 2 which is typically of concrete having metal threaded members 6 engaged in it—is positioned on the top of a support structure (not shown) leading to an underground installation. The bolts 14 are threaded into the threaded members 6 and the insert 8 is then placed in the opening 4 on the threaded members 6. Adjustment of the position of the insert 8 is easily carried out, typically by positioning three of the bolts 14 to secure the correct height and also the correct angulation of insert 8. Once the correct position is obtained the remaining three bolts 14 are moved up to contact the insert 8 to provide additional support. Major adjustment in height can be made by simply replacing one insert 8 with an insert 8 of different height. Fine adjustment is then carried out by bolts 14.

In the illustrated embodiment the flange 12 is not essential and, furthermore, the recesses 16 and 20 need not be present. However, both these features are desirable first to provide adequate support for the insert 8 and secondly, to avoid restriction of access to the manhole.

Typically the insert is of grey iron. As will be immediately appreciated by the skilled man a manhole cover fits into the insert 8. It is typically supported on a flange 32 at the internal periphery of the insert 8.

I claim:

1. An adjustable manhole cover support comprising:
   an outer ring having a circular internal opening;
   a plurality of threaded members disposed about the circular opening;
   an insert dimensioned to fit within the outer ring to a depth controlled by the abutment of the insert against the threaded members;
   studs to engage and to extend through the threaded members to abut an under surface of the insert to provide control of the depth of the insert into the outer ring and the angulation of the insert, the studs being defined by bolts having enlarged heads; and
   a locking member loosely fitted on the head of the bolt and able to contact sides of the ring when in contact with the head to prevent rotation of the bolt.

2. An adjustable manhole cover support as claimed in claim 1 including recesses formed in an internal periphery of the outer ring;
   projections on the insert corresponding to the recesses; and wherein the threaded members are positioned at a base of each recess.

3. An adjustable manhole cover support as claimed in claim 2 in which there are six recesses and a corresponding number of projections and threaded members, all evenly disposed about the internal opening.

4. An adjustable manhole cover support as claimed in claim 2 including a plurality of second recesses in the outer ring, one beneath each threaded member, to receive a bolt.

5. An adjustable manhole cover support as claimed in claim 4 in which each locking member is shaped on at least a portion of its exterior to correspond to the shape of at least a portion of a second recess to prevent rotation of the bolt.

6. An adjustable manhole cover support as claimed in claim 1 including a sealing strip between the outer ring and the insert.

7. An adjustable manhole cover support as claimed in claim 6 in which there is a channel to receive said sealing strip.

* * * * *